US009907395B2

(12) United States Patent
Du

(10) Patent No.: US 9,907,395 B2
(45) Date of Patent: Mar. 6, 2018

(54) HINGE MEMBER AND FOLDABLE STRUCTURE INCORPORATING THE SAME

(71) Applicant: SHANGHAI XINTANG INDUSTRIAL CO., LTD, Shanghai (CN)

(72) Inventor: Chuankui Du, Shanghai (CN)

(73) Assignee: SHANGHAI XINTANG INDUSTRIAL CO., LTD, Shanghai (CN)

( * ) Notice: Subject to any disclaimer, the term of this patent is extended or adjusted under 35 U.S.C. 154(b) by 0 days.

(21) Appl. No.: 15/505,799

(22) PCT Filed: Aug. 22, 2014

(86) PCT No.: PCT/CN2014/085018

§ 371 (c)(1),
(2) Date: Feb. 22, 2017

(87) PCT Pub. No.: WO2016/026140

PCT Pub. Date: Feb. 25, 2016

(65) Prior Publication Data

US 2017/0265640 A1 Sep. 21, 2017

(51) Int. Cl.
*A47B 3/00* (2006.01)
*A47B 3/087* (2006.01)
(Continued)

(52) U.S. Cl.
CPC ..... *A47B 3/087* (2013.01); *A47B 3/10* (2013.01); *A47B 2200/0064* (2013.01); *A61G 13/009* (2013.01)

(58) Field of Classification Search
CPC ..... A47B 3/087; A47B 3/002; A47B 3/08; A47B 3/083; A47B 3/10; A47B 13/02;
(Continued)

(56) References Cited

U.S. PATENT DOCUMENTS 5,009,170 A * 4/1991 Spehar ..... A47L 33/10 108/132
5,524,555 A 6/1996 Fanuzzi
(Continued)

FOREIGN PATENT DOCUMENTS

CN 201073424 Y 6/2008
CN 102293703 A 12/2011
(Continued)

OTHER PUBLICATIONS

International Search Report dated Apr. 29, 2015 in International Application PCT/CN2014/085018.
(Continued)

*Primary Examiner* — Daniel J Rohrhoff
(74) *Attorney, Agent, or Firm* — Pillsbury Winthrop Shaw Pittman LLP

(57) ABSTRACT

Hinge members and foldable structures incorporating the same are described herein. A foldable structure includes a section, a brace, and a hinge member attaching to the section to enable the section to move between a folded position and an extended position. The hinge member includes a first bracket and a second bracket that are hingedly joined to each other. The first bracket includes a first flange that is integrally formed and extending from the first bracket. The first brace is attached, between the first flange of the first bracket and a surface of a different structure, to the first hinge member.

28 Claims, 3 Drawing Sheets

(51) Int. Cl.
*A47B 3/10* (2006.01)
*A61G 13/00* (2006.01)

(58) Field of Classification Search
CPC . A61G 13/009; Y10T 16/2771; Y10T 16/283; Y10T 16/52
See application file for complete search history.

(56) References Cited

U.S. PATENT DOCUMENTS 5,676,062 A * 10/1997 Lloyd ..... A47B 3/087 108/132
5,943,965 A * 8/1999 Riach ..... A47B 3/087 108/131
5,974,979 A * 11/1999 Grady ..... A47B 3/087 108/123
6,000,345 A * 12/1999 Gillotti ..... A47B 3/087 108/132
6,076,472 A * 6/2000 Lloyd ..... A47B 3/087 108/132
6,705,234 B1 * 3/2004 Miller ..... A47B 3/087 108/115
2006/0053557 A1 3/2006 Damron
2006/0260053 A1 11/2006 Roleder et al.
2006/0288484 A1 12/2006 Roleder et al.
2009/0077749 A1 3/2009 Roleder et al.
2014/0190371 A1 * 7/2014 Woog ..... A47B 3/0912 108/36

FOREIGN PATENT DOCUMENTS

CN 202760809 U 3/2013
CN 203970800 U 12/2014
CN 203979107 U 12/2014
WO 2006138298 A2 12/2006

OTHER PUBLICATIONS

International Search Report dated May 25, 2015 in International Application PCT/CN2015/085021.
International Preliminary Report on Patentability dated Feb. 28, 2017 in International Application PCT/CN2015/072092.
International Preliminary Report on Patentability dated Feb. 28, 2017 in International Application PCT/CN2014/085018.
International Preliminary Report on Patentability dated Feb. 28, 2017 in International Application PCT/CN2014/085021.
International Search Report dated May 19, 2015 in International Application PCT/CN2015/072092.
International Preliminary Report on Patentability dated Feb. 28. 2017 in International Application PCT/CN2014/085021.
Extended European Search Report dated Dec. 14, 2017 in European Application 15833207.2.

* cited by examiner

HINGE MEMBER AND FOLDABLE STRUCTURE INCORPORATING THE SAME

CROSS REFERENCE TO RELATED APPLICATION

This application is a U.S. National Phase patent application of PCT/CN2014/085018, filed Aug. 22, 2014, which is hereby expressly incorporated by reference in its entirety.

BACKGROUND

1. Technical Field

The present teachings relate to hinge members and foldable structures incorporating the same.

2. Discussion of Technical Background

Foldable structures, e.g., foldable tables, chairs, are widely used. Such a structure may be folded to a reduced size (compared to when it is extended) such that it is convenient for, e.g., transportation and/or storage purposes, and extended to an extended or working configuration when needed. A foldable structure may have one or more connecting components, e.g., hinge members, that are configured to facilitate the movements of different parts of the foldable structure relative to each other, between a folded configuration and an extended or working configuration of the foldable structure. For example, a hinge member connecting two sections of a foldable structure may enable the sections to move with respect to each other from a folded configuration to an extended or working configuration. A hinge member may have an impact on properties including, e.g., strength, rigidity, stability, reliability, and durability, of the foldable structure into which the hinge member is incorporated.

SUMMARY

The teachings disclosed herein relate to hinge members and foldable structures incorporating the same.

In one example, a foldable structure is provided. The foldable structure includes a section, a brace, and a hinge member attaching to the section to enable the section to move between a folded position and an extended position. The hinge member includes a first bracket and a second bracket that are hingedly joined to each other. The first bracket includes a first flange that is integrally formed and extending from the first bracket. The first brace is attached, between the first flange of the first bracket and a surface of a different structure, to the first hinge member.

In another example, a foldable table is provided. The foldable table includes a first tabletop and a second tabletop configured in one of a folded configuration and an extended configuration, a first brace and a second brace; and a pair of hinge members attaching to the first tabletop and the second tabletop to enable the first tabletop and the second tabletop to move between the folded configuration and the extended configuration. A first hinge member of the pair of hinge members includes a first bracket and a second bracket that are hingedly joined to each other. The first bracket includes a first flange that is integrally formed and extending from the first bracket. The second bracket includes a second flange that is integrally formed and extending from the second bracket. The second hinge member of the pair includes a third bracket and a fourth bracket that are hingedly joined to each other. The third bracket includes a third flange that is integrally formed and extending from the third bracket. The fourth bracket includes a fourth flange that is integrally formed and extending from the fourth bracket. The pair of hinge members are positioned such that the first brace is pivotally attached, between the first flange of the first bracket and the third flange of the third bracket, to the pair of hinge members, and that the second brace is pivotally attached, between the second flange of the second bracket and the fourth flange of the fourth bracket, to the pair of hinge members.

Additional features will be set forth in part in the description which follows, and in part will become apparent to those skilled in the art upon examination of the following and the accompanying drawings or may be learned by production or operation of the examples. The features of the present teachings may be realized and attained by practice or use of various aspects of the structures and combinations set forth in the detailed examples discussed below.

BRIEF DESCRIPTION OF THE DRAWINGS

The hinge members and foldable structures incorporating the same described herein are further described in terms of exemplary embodiments. These exemplary embodiments are described in detail with reference to the drawings. The drawings are not to scale. These embodiments are non-limiting exemplary embodiments, in which like reference numerals represent similar structures throughout the several views of the drawings, and wherein.

DETAILED DESCRIPTION

Figure 1:
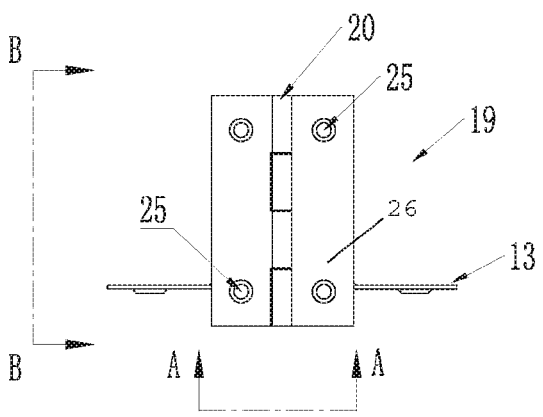
FIG. 1 is a perspective view of an exemplary hinge member according to some embodiments of the present teachings.

In the following detailed description, numerous specific details are set forth by way of examples in order to provide a thorough understanding of the relevant teachings. However, it should be apparent to those skilled in the art that the present teachings may be practiced without such details. In other instances, well known structures, components and/or functional or structural relationship thereof, etc., have been described at a relatively high-level, without detail, in order to avoid unnecessarily obscuring aspects of the present teachings.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The present teachings relate to hinge members and foldable structures incorporating the same. In some embodiments, a hinge member includes two brackets, a first bracket and a second bracket. The first bracket and the second bracket may be hingedly joined to each other by, e.g., a hinge pin. As used herein, a first structural component being hingedly joined or connected to a second structural component indicates that the first structural component and the second structural component may rotate relative to each other around an axis, e.g., a hinge pin. A hinge member may be used to coordinate the movements of structural components attached to the hinge member.

Merely by way of example, if two structural components are fixedly attached to two brackets of a hinge member, respectively, the two structural components may move with the brackets to which they are fixedly attached. When the two brackets rotate relative to each other around an axis, the two structural components rotate around the same axis. As used herein, a first structural component being fixedly attached to a second structural component indicates that the first structural component is not movable relative to the second structural component. The first structural component may move along with the second structural component. A fixed attachment may be formed using, for example, a screw, a nail, glue, or the like. Merely by way of example, if the first section is fixedly attached to a bracket of a hinge member using a screw, the first section is not movable relative to the bracket, but may move along with the bracket.

As another example, if two structural components are pivotally attached to two brackets of a hinge member, respectively, the two structural components may move with the brackets to which they are pivotally attached. When the two brackets rotate relative to each other around an axis, the two structural components rotate around the same axis. In addition, either one of the two structural components may also move, e.g., by way of rotation, relative to the bracket of the hinge member to which it is pivotally attached. As used herein, a first structural component being pivotally attached to a second structural component indicates that the first structural component can move, e.g., by way of rotation on or around the attachment point where the first structural component is attached to the second structural component. A pivotal attachment may be formed using, for example, a pivot bolt, a pin, a rivet, a fastener, or the like. Merely by way of example, if a brace is pivotally attached to a hinge member using a pivot bolt (the attachment point), the brace may rotate on or around the pivot bolt.

As used herein, a first structural component being attached, e.g., pivotally, fixedly, hingedly, to a second structural component is used interchangeably with and equivalent to the second structural component being attached to the first structural component being attached. Likewise, a first structural component being connected or joined to/with a second structural component is used interchangeably with and equivalent to the second structural component being connected or joined to/with the first structural component.

Figure 2:
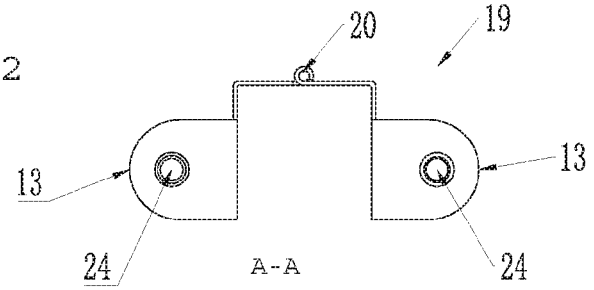
FIG. 2 is a side view of the exemplary hinge member illustrated in FIG. 1 as viewed from a plane indicated as A-A.
Figure 3:
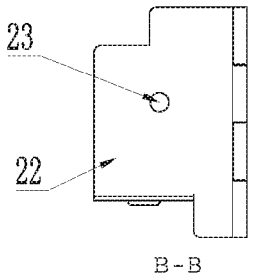
FIG. 3 is a side view of the exemplary hinge member illustrated in FIG. 1 as viewed from a plane indicated as B-B.

Some embodiments of the present teachings provide a hinge member that is configured to connect multiple parts of a foldable structure such that the parts may move relative to each other in a coordinated way. FIGS. 1-3 show various views of an exemplary hinge member according to some embodiments of the present teachings. It is understood that it is for illustration purposes and not intended to limit the scope of the present teachings.

FIG. 1 is a perspective view of an exemplary hinge member according to some embodiments of the present teachings. The hinge member 19 includes two brackets, a first bracket and a second bracket, that are hingedly joined by the hinge pin 20. The first bracket includes a first fastening plane 26, a flange 13, and a second fastening plane 22 (see FIG. 3). The first fastening plane 26 and the second fastening plane 22 are substantially perpendicular to each other. The first fastening plane 26 on the first bracket includes two fastening holes 25 that facilitate fixedly attaching the first bracket of the hinge member 19 to a structural component, e.g., the first tabletop 1 or the second tabletop 1' of the exemplary foldable table illustrated in FIGS. 4-8. In the exemplary hinge member, the first bracket and the second bracket are symmetric to each other.

FIG. 2 is a side view of the exemplary hinge member illustrated in FIG. 1 as viewed from a plane indicated as A-A. The flange 13 on a bracket include a hole 24 that facilitates pivotally attaching the first brace member 5 to the flange 13 of the hinge member 19 by accommodating, e.g., a pivot bolt.

FIG. 3 is a side view of the exemplary hinge member illustrated in FIG. 1 as viewed from a plane indicated as B-B. The second fastening plane 22 on a bracket includes a fastening hole 23 that facilitates fixedly attaching the bracket of the hinge member 19 to a structure, e.g. a foldable structure incorporating the hinge member.

As illustrated in FIGS. 1-3, a bracket, e.g., a first bracket or a second bracket, of a hinge member, may include one or more fastening planes that facilitate the attachment of the hinge member to another structure or structural component, e.g., a section of a foldable structure, into which the hinge member is incorporated. In some embodiments, there are one or more fastening holes on at least one of the fastening planes, referred to as a first fastening plane, such that the section of the foldable structure may be attached to the first fastening plane of the bracket. Such an attachment can be a fixed attachment, a pivotal attachment, a slidable attachment, or the like. In some embodiments, the bracket includes a second fastening plane. The second fastening plane may be perpendicular to the first fastening plane. The angle between the first fastening plane and the second fastening plane may be different from 90°. The second fastening plane may have the same number and/or size of fastening holes, and/or same shape and/or size as the first fastening plane. The second fastening plane may be different from the first fastening plane in terms of, e.g., shape, size, or the number or size of fastening holes. Merely by way of example, the section of a foldable structure may be fixedly attached to the first fastening plane of the bracket using, e.g., one or more screws, while fixedly attached to the second fastening plane of the bracket using, e.g., one or more nails, or glue. The first fastening plane and the second fastening plane of the same bracket may be attached to the same structure or structural component, or different structures or structural components, or different structural components of the same structure. As used herein, a structure may include one or more structural components.

In some embodiments, at least one of the two brackets of a hinge member includes a flange that is integrally formed and extending from the bracket. The flange is configured to facilitate the attachment of the hinge member to a structural component. The flange may include one or more fastening holes to facilitate attaching, e.g., fixedly or pivotally, the hinge member to a structural component. Merely by way of example, the flange includes a fastening hole to facilitate pivotally attaching a brace (e.g., at one end thereof) to the hinge member, and the brace (or an end of the brace) is attached between the flange and a surface of a different structure (e.g., a wall, a different hinge member). The size of the space where the brace is received and attached to the hinge member may be adjusted by adjusting the position of the hinge member relative to the different structure (or the surface of the different structure). When a pair of hinge members are used together, the hinge members may be positioned such that the brace (or an end of the brace) is attached, between the two flanges (one from each of the pair of hinge members) to both hinge members. The size of the space where the brace is received and attached to the hinge members may be adjusted by adjusting the relative position of the pair of hinge members.

In some embodiments, the second bracket of a hinge member is the same as the first bracket except that they are symmetric, i.e. the second bracket being a mirror image of the first bracket. See, for example, the exemplary hinge member illustrated in FIG. 1.

In some embodiments, the second bracket of the hinge member is different from the first bracket in terms of, e.g., the number and/or shape of the fastening plane(s), the number of fastening hole(s), and the number and/or shape of the flange(s). Merely by way of example, a hinge member is incorporated into a foldable table attached to a wall. The foldable table has a first section that is attached to the wall, a brace for providing support to the first section, and the hinge member attaching to the first section to enable the first section to move between a first position and a second position. At its first position, the first section is folded and essentially parallel to the wall. At its second position, the first section is extended and essentially perpendicular to the wall. The hinge member has a first bracket and a second bracket hingedly joined to each other. The first bracket has a fastening plane and a flange, and is configured to facilitate the attachment of the hinge member to the first section and also the brace. The second bracket is different from the first bracket. The second bracket does not have a flange, and is configured to facilitate the attachment of the hinge member to the wall. The way the second bracket is attached to the wall may be the same as or different from that the first bracket is attached to the first section.

In some embodiments, a hinge member disclosed herein is incorporated into a foldable structure. The foldable structure may be folded to a reduced size (compared to when it is extended) such that it is convenient for, e.g., transportation and/or storage purposes, and extended to an extended or working configuration when needed. The foldable structure may be, for example, a foldable table, a foldable chair, or the like. The foldable table may be a foldable massage table, or a foldable table for medical or other uses. For example, the foldable table may be used for, e.g., picnic, trade or road shows, or the like.

FIGS. 4-8 show various views of an exemplary foldable table incorporating a plurality of exemplary hinge members according to some embodiments of the present teachings. It is understood that it is for illustration purposes and not intended to limit the scope of the present teachings. One or more hinge members disclosed herein may be incorporated into a foldable structure other than the exemplary foldable table illustrated in FIGS. 4-8.

Figure 4:
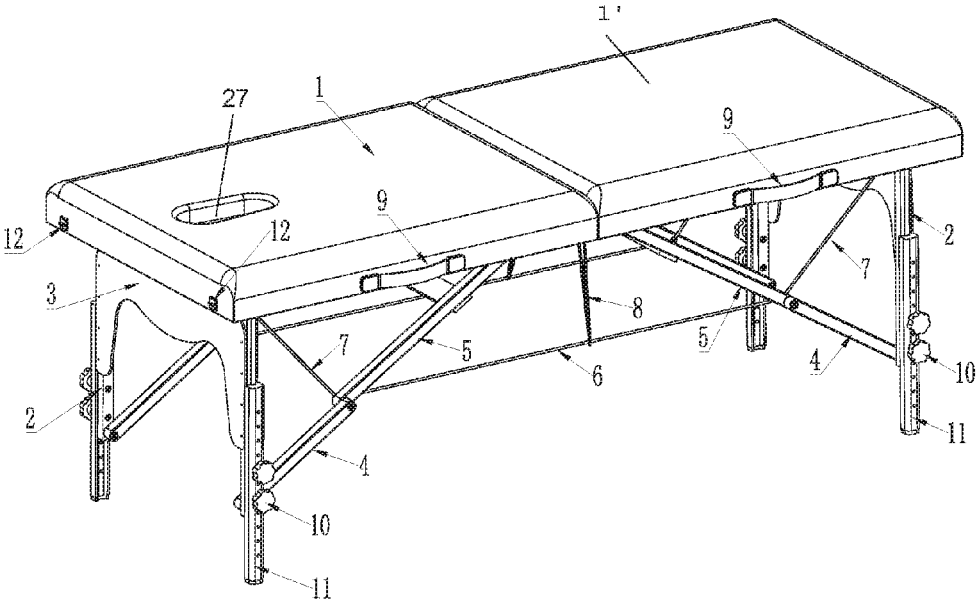
FIG. 4 is a perspective view of an exemplary foldable table according to some embodiments of the present teachings.

FIG. 4 illustrates a perspective view of an exemplary foldable table in its extended configuration according to some embodiments of the present teachings. The exemplary foldable table may be a massage table. The foldable table includes a first tabletop 1, and a second tabletop 1'. The first tabletop 1 has a hole 27. The hole 27 may serve as a face hole if the foldable structure is a foldable massage table or a foldable table for medical uses. The first tabletop 1 and the second tabletop 1' are hingedly connected using two pairs of (totally four) hinge members 19 (see FIG. 7). The foldable table has four substantially identical supporting assemblies pivotally attached to the outer corners of the first tabletop 1 and the second tabletop 1' of the foldable table, respectively. Each supporting assembly is associated with a mounting block 18 (see FIGS. 6 and 7), and a brace including a first brace member 5 and a second brace member 4. The braces may provide support for the tabletops when the foldable table is in its extended or working configuration. The supporting assembly may include a leg.

The supporting assembly includes a leg section 2, an adjustable leg section 11, and two bolts 10. The leg section 2 and the adjustable leg section 11 each have multiple holes for accommodating the bolts 10. The height of the foldable table may be adjusted by aligning different holes of the leg section 2 and of the adjustable leg section 11, and then securing the relative position of the leg section 2 and the adjustable leg section 11 using two bolts 10. It is understood that more or fewer bolts may be used for securing the relative position of the leg section 2 and the adjustable leg section 11.

Figure 7:
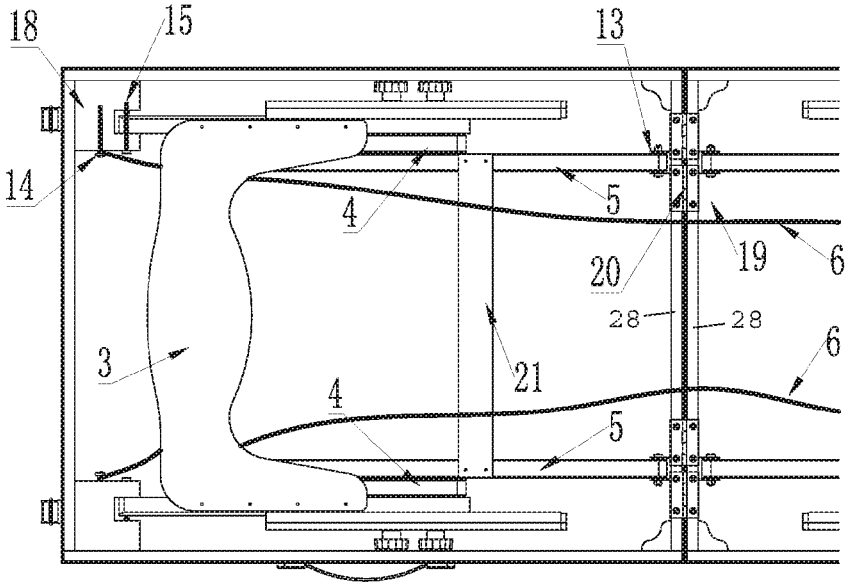
FIG. 7 is an enlarged view of the underside surface of one of the tabletops of the exemplary foldable table when the exemplary foldable table is in a partially folded configuration.

The leg section 2 is pivotally attached to the mounting block 18 on the underside of the first tabletop 1 or the second tabletop 1' such that the supporting assembly may be extended as shown in FIG. 4, or folded as shown in FIG. 7.

The first brace member 5 of the brace and the second brace member 4 of the brace are pivotally attached. The first brace member 5 of the brace is pivotally attached at one end (the first end of the brace), to the underside of the first tabletop 1 or the second tabletop 1'. The second brace member 4 of the brace is pivotally attached at one end (the second end of the brace), to the supporting assembly. In the exemplary foldable table illustrated in FIG. 4, the point where the second brace member 4 is pivotally attached to the supporting assembly is different from where the bolts 10 are located.

The brace including the first brace member 5 and the second brace member 4 is further attached to the cable 6 and the cable 7. The cable 6 connects the two braces of the opposing supporting assemblies, one supporting assembly pivotally attached to the first tabletop 1 and one supporting assembly pivotally to the second tabletop 1'. The cable 6 is also held by a rubber band 8. The rubber band 8 is connected to the underside of the first tabletop 1 or the second tabletop 1' underneath the pairs of hinge members 19 (see FIG. 7). The cable 7 connects, on one end, the brace where the first brace member 5 and the second brace member 4 are pivotally attached, and, on the other end, the mounting block 18 on the underside of the first tabletop 1 or the second tabletop 1'. The cable 7 and the cable 6 may facilitate the setup of the foldable table by causing the supporting assemblies to unfold when the hingedly connected first tabletop 1 and second tabletop 1' are unfolded to, e.g., a co-planar configuration. These cables may also prevent upward folding of each brace including the first brace member 5 and the second brace member 4 when the first tabletop 1 and the second tabletop 1' are unfolded to, e.g., a co-planar configuration, thereby preventing the supporting assemblies from collapsing when the foldable table is being used.

The folding of the brace including the first brace member 5 and the second brace member 4 may be facilitated by an elongated strut including a slot. A pivot bolt attaching the first brace member 5 and the second brace member 4 may slide in the slot of the elongated strut.

Between the opposing supporting assemblies pivotally attached to the same tabletop, i.e. the opposing supporting assemblies pivotally attached to the first tabletop 1, or the opposing supporting assemblies pivotally attached to the second tabletop 1', there is an end plate 3. Between the two braces of the opposing supporting assemblies pivotally attached to the same tabletop, i.e. the two braces of the opposing supporting assemblies pivotally attached to the first tabletop 1, or the two braces of the opposing supporting assemblies pivotally attached to the second tabletop 1', there is a cross brace 21 (see FIG. 7). The end plates 3 and the cross braces 21 may improve the properties of the foldable table including, e.g., strength, rigidity, stability, reliability, and durability.

Each of the first tabletop 1 and the second tabletop 1' further includes a carrying handle 9, and two closing latches 12.

Figure 5:
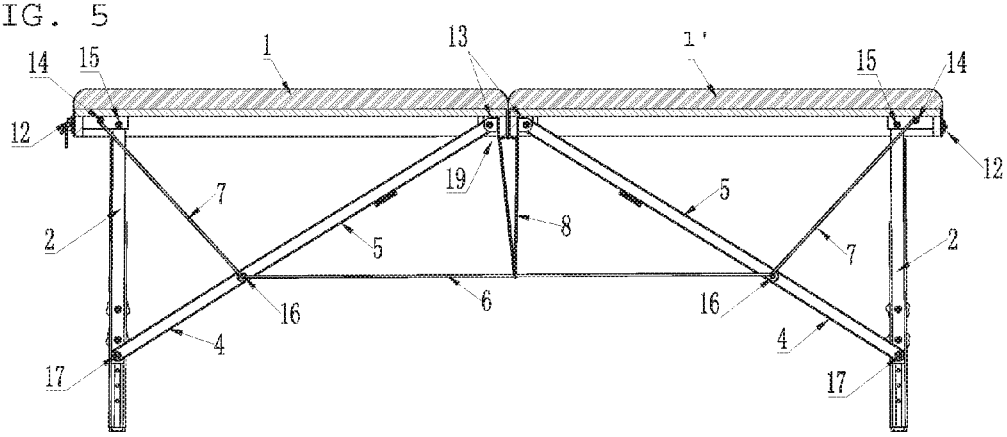
FIG. 5 is a cross-sectional view of the exemplary foldable table illustrated in FIG. 4.
Figure 6:
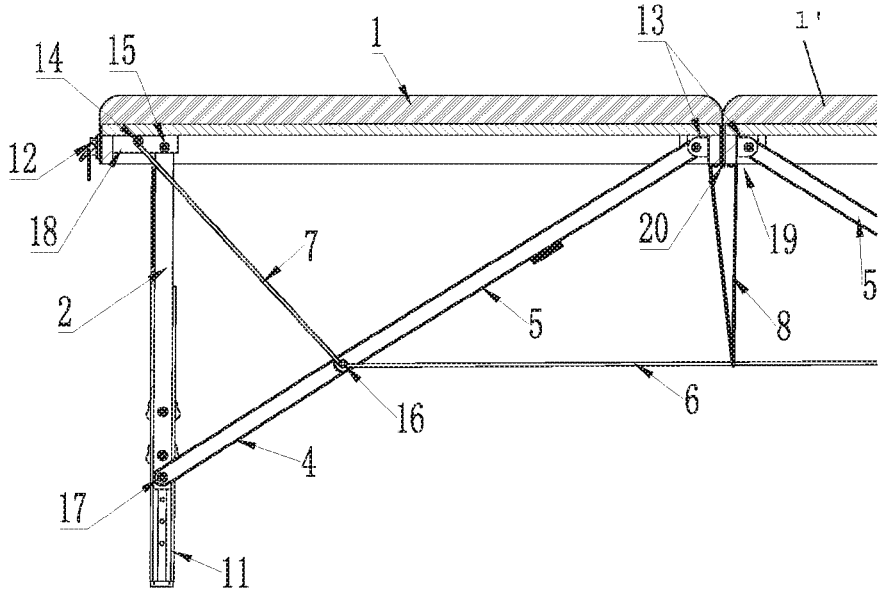
FIG. 6 is an enlarged view of the cross-sectional view of the exemplary foldable table illustrated in FIG. 5.

FIG. 5 is a cross-sectional view of the exemplary foldable table illustrated in FIG. 4. FIG. 6 is an enlarged view of the cross-sectional view of the exemplary foldable table illustrated in FIG. 4. In addition to what is described in connection with FIG. 4, FIGS. 5 and 6 show flanges 13, pivot bolts 14, 15, 16, and 17, and hinge members 19. The pivot bolt 14 pivotally attaches the cable 7 to the mounting block 18. The pivot bolt 15 pivotally attaches the supporting assembly to the mounting block 18. The pivot bolt 14 and the pivot bolt 15 are spaced apart by a small distance on the mounting block 18. The pivot bolt 16 connects the cable 7, the first brace member 5, the second brace member 4, and the cable 6. The pivot bolt 17 pivotally attaches the second brace member 4 to the supporting assembly. The hinge members 19 include the flanges 13. The hinge members 19 are positioned that the flanges 13 form a receiving area for receiving and pivotally attaching the first brace members 5 to the hinge members 19. Further shown in FIG. 6 is a hinge pin 20.

FIG. 7 is an enlarged view of the underside surface of one of the tabletop of the exemplary foldable table when the exemplary foldable table is in a partially folded configuration. In FIG. 7, the opposing supporting assemblies on the first tabletop 1 are folded, while the first tabletop 1 and the second tabletop 1' are unfolded, in a co-planar configuration. Each of the sections, the first tabletop 1 and the second tabletop 1', includes a frame member 28. The frame member 28 facilitates the attachment of the hinge members 19 to the section including the frame member.

Figure 8:
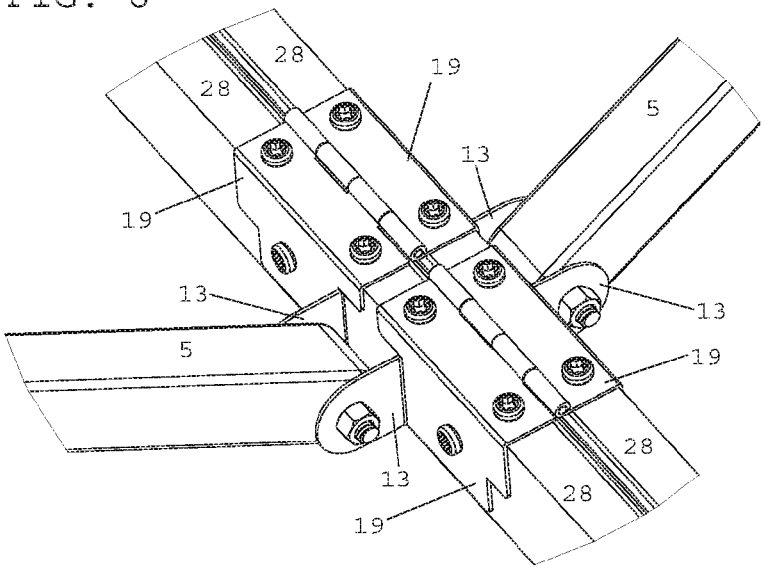
FIG. 8 is an enlarged perspective view of a pair of exemplary hinge members attached to two frame members, and also attached to two brace members.

FIG. 8 is an enlarged perspective view of a pair of exemplary hinge members fixedly attached to two frame members 28, and pivotally attached to two first brace members 5.

One or more hinge members disclosed herein may be incorporated into a foldable structure other than that illustrated in FIGS. 4-8. The foldable structure may include a section and a brace that are attached to a hinge member disclosed herein. The section of the foldable structure may be a tabletop of a foldable table, or a section of a foldable chair (e.g., a section to provide back support, or a section on which a user sits), or the like. It is understood that a section may be located in a position other than the top of the foldable structure when the foldable structure is in its folded configuration or in its extended configuration.

The foldable structure may include more than one section. In some embodiments, the foldable structure includes two sections, a first section and a second section. The first section and the second section may be the same, or symmetric (i.e. the second section being a mirror image of the first section). The second section may be different from the first section. See, for example, the exemplary foldable table illustrated in FIG. 4, in which one of the two tabletops includes the hole 27. When the foldable structure is in its extended or working configuration, one or both of the first section and the second section are in their respective extended position, and they may be co-planar. When the foldable structure is in its folded configuration, one or both of the first section and the second section are in their respective folded position.

In some embodiments, the foldable structure includes the first section and the second section. A hinge member may be attached to both of the first section and the second section. The first bracket of a hinge member may be attached, fixedly or otherwise, to the first section, and the second bracket of the same hinge member may be attached, fixedly or otherwise, to the second section. The attachment of the first bracket of the hinge member to the first section may be the same as or different from the attachment of the second bracket of the hinge member to the second section. The second bracket of the hinge member may be symmetric to the first bracket of the same hinge member. The second bracket of the hinge member may be different from the first bracket of the same hinge member.

The foldable structure may include one or more braces for providing support for the section(s) when in the extended or working position. The brace may be attached to a section of the foldable structure via one or more hinge members. The hinge member that attaches the brace to the foldable structure may be the same hinge member that attaches to the section of the foldable structure. The hinge may include a flange such that the brace (or an end of the brace) is attached between the flange and a surface of a different structure (e.g., a wall, a different hinge member). The size of the space where the brace is received and attached to the hinge member may be adjusted by adjusting the position of the hinge member relative to the different structure (or the surface of the different structure). When a pair of hinge members are used together, the hinge members may be positioned such that the brace (or an end of the brace) is attached, between the two flanges (one from each of the pair of hinge members) to both hinge members. The size of the space where the brace is received and attached to the hinge members may be adjusted by adjusting the relative position of the pair of hinge members.

In some embodiments, the brace includes a brace member. In some embodiments, the brace includes more than one brace member, wherein at least two brace members are fixedly attached to each other. In some embodiments, the brace includes more than one brace member, wherein at least two brace members are pivotally attached to each other, and the brace is foldable. The brace has a first end and a second end. If the brace includes more than one brace members, the first end and the second end of the brace are located on different brace members, and are available for attaching the brace to a structural component other than the brace members themselves. Merely by way of example, the brace includes two brace members, a first brace member and a second brace member, pivotally attached to each other. The first end of the brace is located on the first brace member, and the second end of the brace is located on the second brace member. The first end of the brace may be pivotally attached to a hinge member, and the second end of the brace may be pivotally attached to a different structural component other than the first brace member of the brace, e.g., a wall, or a supporting assembly. The brace may be attached to the hinge member or a different structural component at a location other than the first end or the second end of the brace.

The foldable structure may include a supporting assembly. In some embodiments, the supporting assembly is pivotally attached to a section of the foldable structure, e.g., the first section or the second section of the foldable structure. The foldable structure may include more than one supporting assembly. In some embodiments, at least one supporting assembly is fixedly attached to a section of the foldable structure, if the supporting assembly does not need to be foldable or otherwise movable relative to the section of the foldable structure. The supporting assembly may be attached, e.g., pivotally or otherwise, to a brace that may provide support to the section of the foldable structure. In some embodiments, at least one supporting assembly is fixedly attached to a brace of the foldable structure, if the supporting assembly does not need to be foldable or otherwise movable relative to the brace of the foldable structure. In some embodiments, the supporting assembly includes a leg. In some embodiments, the supporting assembly is configured to be able to adjust the height of the foldable structure.

In some embodiments, the foldable structure further includes at least one structural component selected from the group consisting of a cable, an end plate, a cross brace, and a rubber band, or the like.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A foldable structure comprising a first section in one of a first folded position and a first extended position;

a first brace; and a first hinge member attaching to the first section to enable the first section to move between the first folded position and the first extended position, wherein the first hinge member comprises a first bracket and a second bracket that are hingedly joined to each other, the first bracket comprises a first flange that is integrally formed and extending from the first bracket, and the first brace is attached, between the first flange of the first bracket and a surface of a different structure, to the first hinge member.

2. The foldable structure of claim 1, wherein the first bracket and the second bracket of the first hinge member are hingedly joined by a hinge pin.

3. The foldable structure of claim 1, wherein the first bracket is fixedly attached to the first section.

4. The foldable structure of claim 1, wherein the first section comprises a first frame member, and the first bracket is attached to the first frame member of the first section.

5. The foldable structure of claim 1, wherein the first bracket comprises a first fastening plane, and the first bracket is attached, at the first fastening plane, to the first section.

6. The foldable structure of claim 5, wherein the first bracket comprising the first fastening plane comprises a second fastening plane, and the first bracket is attached, at the second fastening plane, to the first section.

7. The foldable structure of claim 6, wherein the first fastening plane is perpendicular to the second fastening plane.

8. The foldable structure of claim 1, wherein the first brace comprises a first brace member and a second brace member.

9. The foldable structure of claim 8, wherein the first brace member and the second brace member are pivotally attached to each other.

10. The foldable structure of claim 1, wherein the first brace is pivotally attached to the first flange of the first hinge member.

11. The foldable structure of claim 1 further comprising a supporting assembly, wherein the supporting assembly is attached to the first section.

12. The foldable structure of claim 11, wherein the supporting assembly is pivotally attached to the first section.

13. The foldable structure of claim 11, wherein the supporting assembly is attached to the first brace.

14. The foldable structure of claim 13, wherein the supporting assembly is pivotally attached to the first brace.

15. The foldable structure of claim 11, wherein the supporting assembly comprises a leg.

16. The foldable structure of claim 11, wherein the supporting assembly is configured to adjust the height of the foldable structure.

17. The foldable structure of claim 1 comprising a second hinge member attaching to the first section to enable the first section to move between the first folded position and the first extended position, wherein the second hinge member comprises a third bracket and a fourth bracket that are hingedly joined to each other, the third bracket of the second hinge member comprises a second flange that is integrally formed and extending from the third bracket, and the first hinge member and the second hinge member are positioned such that the first brace is pivotally attached, between the first flange and the second flange, to the first hinge member and the second hinge member.

18. The foldable structure of claim 1 further comprising a second section in one of a second folded position and a second extended position, wherein the first hinge member attaches to the second section to enable the second section to move between the second folded position and the second extended position.

19. The foldable structure of claim 18, wherein the second bracket of the first hinge member is fixedly attached to the second section.

20. The foldable structure of claim 18 further comprising a second brace, wherein the second bracket of the first hinge member comprises a second flange that is integrally formed and extending from the second bracket, and the second brace is attached, between the second flange of the second bracket and a surface of a different structure, to the first hinge member.

21. The foldable structure of claim 18, wherein the second section comprises a second frame member, and the second bracket of the first hinge member is attached to the second frame member of the second section.

22. The foldable structure of claim 18 further comprising a second hinge member, wherein the second hinge member attaches to the first section to enable the first section to move between the first folded position and the first extended position, and the second hinge member attaches to the second section to enable the second section to move between the second folded position and the second extended position.

23. The foldable structure of claim 1 further comprising at least one structural component selected from the group consisting of a cable, an end plate, a cross brace, and a rubber band.

24. The foldable structure of claim 1, wherein the foldable structure is a table or a chair.

25. A foldable table comprising a first tabletop and a second tabletop configured in one of a folded configuration and an extended configuration;

a first brace and a second brace; and a pair of hinge members attaching to the first tabletop and the second tabletop to enable the first tabletop and the second tabletop to move between the folded configuration and the extended configuration, wherein a first hinge member of the pair comprises a first bracket and a second bracket that are hingedly joined to each other, the first bracket comprising a first flange that is integrally formed and extending from the first bracket, and the second bracket comprising a second flange that is integrally formed and extending from the second bracket;

a second hinge member of the pair comprises a third bracket and a fourth bracket that are hingedly joined to each other, the third bracket comprising a third flange that is integrally formed and extending from the third bracket, and the fourth bracket comprising a fourth flange that is integrally formed and extending from the fourth bracket;

the pair of hinge members are positioned such that the first brace is pivotally attached, between the first flange of the first bracket and the third flange of the third bracket, to the pair of hinge members, and that the second brace is pivotally attached, between the second flange of the second bracket and the fourth flange of the fourth bracket, to the pair of hinge members.

26. The foldable table of claim 25 further comprising a plurality of legs.

27. The foldable table of claim 26, wherein at least one of the legs is configured to adjust the height of the foldable table.

28. The foldable table of claim 26, wherein at least one of the legs is attached to one of the first tabletop and the second tabletop, and the leg is configured to be movable relative to the tabletop to which it is attached.

* * * * *